US009243421B2

(12) United States Patent
Jin

(10) Patent No.: US 9,243,421 B2
(45) **Date of Patent: *Jan. 26, 2016**

(54) FOLDABLE TENT

(71) Applicant: Ki Ho Jin, Xiamen (CN)

(72) Inventor: Ki Ho Jin, Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,511

(22) Filed: Oct. 15, 2014

(65) Prior Publication Data

US 2015/0068571 A1 Mar. 12, 2015

Related U.S. Application Data

(63) Continuation of application No. 13/445,086, filed on Apr. 12, 2012, now Pat. No. 8,869,814.

(30) Foreign Application Priority Data

May 4, 2011 (CN) ..... 2011 2 0138004 U

(51) Int. Cl.
*E04H 15/16* (2006.01)
*E04H 15/34* (2006.01)

(52) U.S. Cl.
CPC ..... *E04H 15/16* (2013.01); *E04H 15/34* (2013.01)

(58) Field of Classification Search
CPC ..... E04H 15/16; E04H 15/14; E04H 15/54
USPC ..... 135/115, 94, 93, 91, 117, 119
See application file for complete search history.

(56) References Cited

U.S. PATENT DOCUMENTS

| | | | |
|---|---|---|---|
| 1,833,095 | A | 11/1931 | Isidore |
| 3,670,747 | A | 6/1972 | Pohl et al. |
| 4,102,352 | A | 7/1978 | Kirkham |
| 4,193,413 | A | 3/1980 | Watts et al. |
| 4,269,210 | A | 5/1981 | Marks |
| 4,827,958 | A | 5/1989 | Cantwell et al. |
| 5,067,505 | A | 11/1991 | Cantwell et al. |
| 5,107,881 | A | 4/1992 | Feldman et al. |
| 5,421,355 | A | 6/1995 | Cantwell |
| 5,853,016 | A | 12/1998 | Cowan |
| 5,871,026 | A | 2/1999 | Lin |
| 6,021,795 | A | 2/2000 | Long et al. |
| 6,021,796 | A | 2/2000 | Vavra |
| 6,463,948 | B2 | 10/2002 | Lee |

(Continued)

FOREIGN PATENT DOCUMENTS

| | | | |
|---|---|---|---|
| CA | 2022369 | A1 | 2/1991 |
| CN | 2635827 | Y | 8/2004 |

(Continued)

*Primary Examiner* — David R Dunn
*Assistant Examiner* — Danielle Jackson
(74) *Attorney, Agent, or Firm* — John H. Choi

(57) ABSTRACT

A tent structure with an improved ventilation system includes a pole assembly, a lower section defined by a plurality of walls and a floor, and an upper section having an inner layer and an outer layer. The inner layer includes a first set of openings covered by an air permeable material. A perimeter of the inner layer is fixedly attached to a top portion of the lower section to form an enclosure. The outer layer is disposed above the inner layer and a second set of openings is formed between a perimeter of the outer layer and the top portion of the lower section. A first set of connecting members connects the inner and outer layers, and forms a space therebetween. A second set of connecting members connects the outer layer and the pole assembly.

14 Claims, 7 Drawing Sheets

(56) References Cited

U.S. PATENT DOCUMENTS

| | | | | |
|---|---|---|---|---|
| 6,499,497 | B1 | 12/2002 | Swetish et al. | |
| D470,907 | S | 2/2003 | Ju | |
| 6,679,643 | B1 | 1/2004 | Ham | |
| 6,681,786 | B2 | 1/2004 | Ju | |
| 7,025,075 | B2 | 4/2006 | Suh | |
| 7,128,077 | B2 | 10/2006 | Cantwell | |
| 7,140,376 | B2 | 11/2006 | Zheng | |
| D534,614 | S | 1/2007 | Gallaway et al. | |
| 7,578,306 | B2 | 8/2009 | Mettavant | |
| 7,621,289 | B2 | 11/2009 | Ju | |
| 7,784,480 | B2 | 8/2010 | Sy-Facunda | |
| 2004/0238021 | A1* | 12/2004 | Holub et al. | 135/97 |
| 2005/0000555 | A1 | 1/2005 | Besse | |
| 2005/0066591 | A1 | 3/2005 | Worley et al. | |
| 2007/0017563 | A1 | 1/2007 | Lah | |
| 2012/0055525 | A1* | 3/2012 | Choi | 135/147 |
| 2012/0125389 | A1 | 5/2012 | Vaughn et al. | |
| 2012/0152293 | A1 | 6/2012 | Lucero | |

FOREIGN PATENT DOCUMENTS

| | | | |
|---|---|---|---|
| CN | 201129060 | Y | 10/2008 |
| EP | 1310616 | A2 | 5/2003 |
| GB | 2121850 | A | 1/1984 |
| GB | 2201703 | A | 9/1988 |
| GB | 2259927 | A | 3/1993 |

* cited by examiner

FOLDABLE TENT

CROSS REFERENCE TO RELATED APPLICATION

This application is a continuation of U.S. application Ser. No. 13/445,086 (filed Apr. 12, 2012), which claims foreign priority to China App. No. 201120138004.8 (filed May 4, 2011), which are incorporated by reference in their entireties.

BACKGROUND OF THE INVENTION

1. Field of the Invention

The present invention relates generally to tents, and more particularly to a tent with an upper section having an air-permeable inner layer spaced apart from a protective outer layer for providing the tent with constant ventilation while protecting the interior of the tent from outdoor elements.

2. Description of Prior Art

Camping is a popular, cost-effective recreational activity for those who seek to experience the outdoors and tents provide temporary shelter to those campers and wilderness explorers. These tents are sold in different sizes and designs, and at varying prices. Despite the variety of tents available today, there are several common complaints by campers.

One common complaint is that tents in general lack sufficient ventilation. Tents tend to become hot when exposed to the sun during the day and also tend to trap moist air at night. Moreover, because a tent is a closed structure, often the air within the tent becomes stale and sometimes the air quality within the tent can become undesirable due to body odor or the like. Consequently, the camper's comfort and enjoyment often depends on the quality of ventilation employed in the tent structure.

Even though tents are commonly equipped with screen windows or doors on one or more sides of the tent, it is still difficult to achieve sufficient ventilation. Moreover, when adverse weather conditions are present such as rain, sleet or snow, or when the camper is concerned with safety or privacy, the windows and doors must be closed and thus the interior of the tent cannot ventilate.

Tent designers and manufacturers have taken different approaches in an effort to provide tents with ventilation without compromising protection of the tent from adverse weather conditions. One approach is to provide the tent with a small cut-out covered with a mesh material and small awnings to protect the cut-outs. These tents are not provided with a separate rain fly and as a result the cut-outs in the tent must be small to minimize the possibility of any precipitation from entering the tent. This type of design, however, limits the amount of air flow and thus prevents the tent from ventilating sufficiently. Moreover, because the tent does not include a protective cover or rain fly, the tent is subject to wear and tear, and is also prone to hot conditions from direct exposure to the sun. Also, precipitation accumulated on the top section of the tent tends to flow down the mid portions of the wall outer surfaces often causing water to leak through windows and doors on the walls as well as the seams surrounding the windows and doors.

Thus, while it is desirable to have a well ventilated tent, it is also necessary that the tent be protected from adverse weather conditions and from overexposure to the sun. This is often achieved by providing a cover or rain fly on an outer surface of the tent.

So, another approach seen in the prior art is to provide a mesh section within the tent and a rain fly extending over the tent, often superposed. In theory, the air should flow out of the tent through the mesh section, into the area between the rain fly and the tent, and then out from under the rain fly. However, because the rain fly extends almost to the ground, the air and condensation may still accumulate underneath the rain fly and proper ventilation may not be supplied. Moreover, because the space between the rain fly and tent is minimal it is often difficult to achieve proper air circulation.

Another problem with the ventilated tents in the prior art is that the cover or rain fly is not integrated with the tent and, thus, the user is required to separately attach and detach the cover or rain fly to and from the tent. Therefore, it would be desirable to have a tent with an integrated ventilation system that is unitary, free-standing and collapsible making it extremely easy to put up, take down and transport.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages and to provide further improvements to tents in the prior art. The objects and advantages of the present invention, more specifically, are to provide a foldable or collapsible tent (i.e., an instant tent) having an improved ventilation system and to provide a rain fly integral to the instant tent such that the user could simply open and collapse the tent without having to assemble or disassemble any components.

For achieving the above-mentioned objects, the present invention generally provides an upper section of a tent having an air permeable inner layer attached and spaced apart from a protective outer layer which is permanently attached to a collapsible pole assembly for providing constant ventilation for the tent while protecting the interior of the tent from bugs, debris and precipitation, as well as overheating due to overexposure to the sun.

More specifically, in one embodiment of the present invention a tent structure is provided with an improved ventilation system comprising a pole assembly, a lower section defined by a plurality of walls and a floor, and an upper section having an inner layer and an outer layer. The inner layer comprises a first set of openings covered by an air permeable material. A perimeter of the inner layer is fixedly attached to a top portion of the lower section to form an enclosure. The outer layer is disposed above the inner layer and a second set of openings is formed between a perimeter of the outer layer and the top portion of the lower section. A first set of connecting members connects the inner and outer layers, and forms a space therebetween. A second set of connecting members connects the outer layer and the pole assembly. An outer seam along the top portion of the lower section is formed from joining the inner layer wherein water from precipitation is collected and prevented from entering onto mid portions of the walls. In another embodiment, the second set of openings is covered with an air permeable material and fixedly attached to the top portion of the lower section. Yet in another embodiment, the inner layer further comprises a tent fabric overlapping with the air permeable material at an outer portion extending along the perimeter of the inner layer.

BRIEF DESCRIPTION OF THE DRAWINGS

The above and other objects, features and advantages of the present invention will be more apparent from the following detailed description taken in conjunction with the accompanying drawings, in which.

Figure 1:
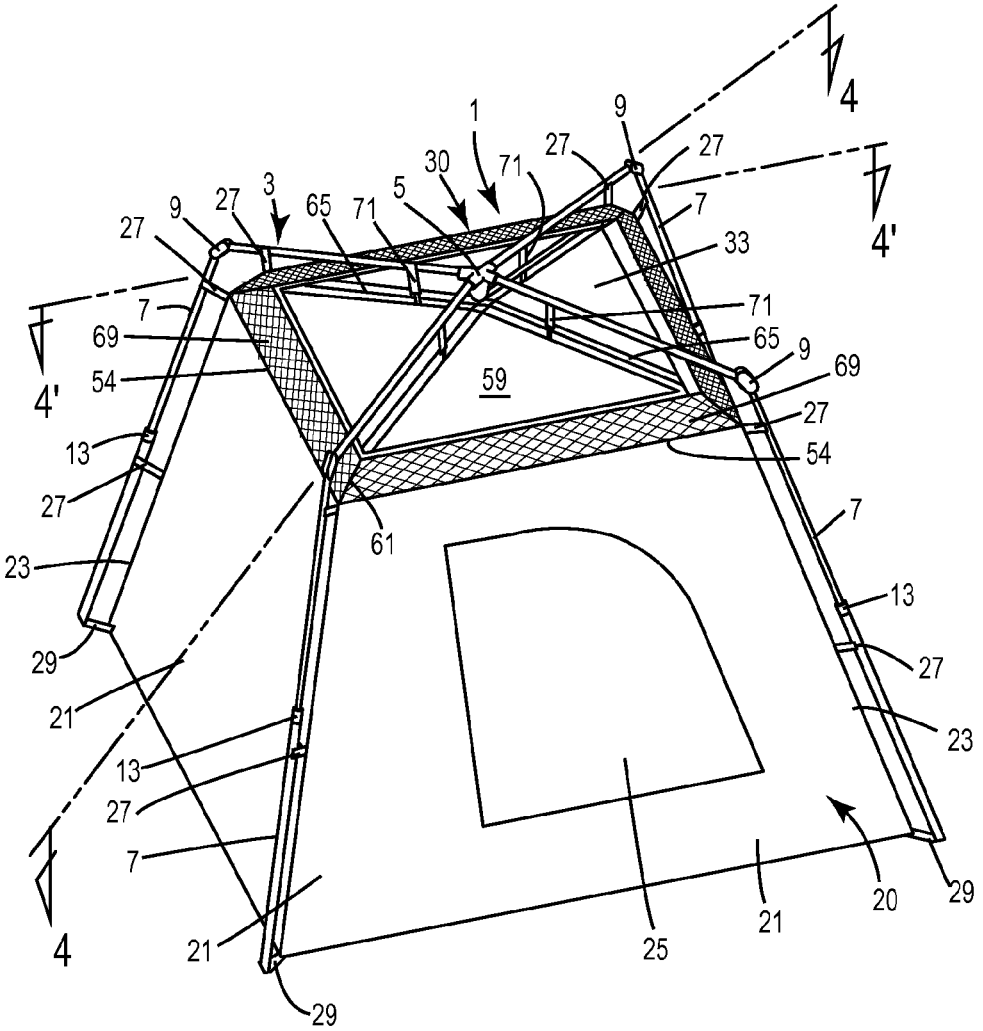
FIG. 1 is a top left perspective view of an embodiment of a tent with an improved ventilation system of the present invention in an open configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENTS

Exemplary embodiments are described herein to provide a detailed description of the invention. Variations of these embodiments will be apparent to those of skill in the art. For example, the invention is described with reference to a collapsible tent, but the invention may also be used in assemble-to-use tents, semi-permanent structures or fixed structures.

Figure 7:
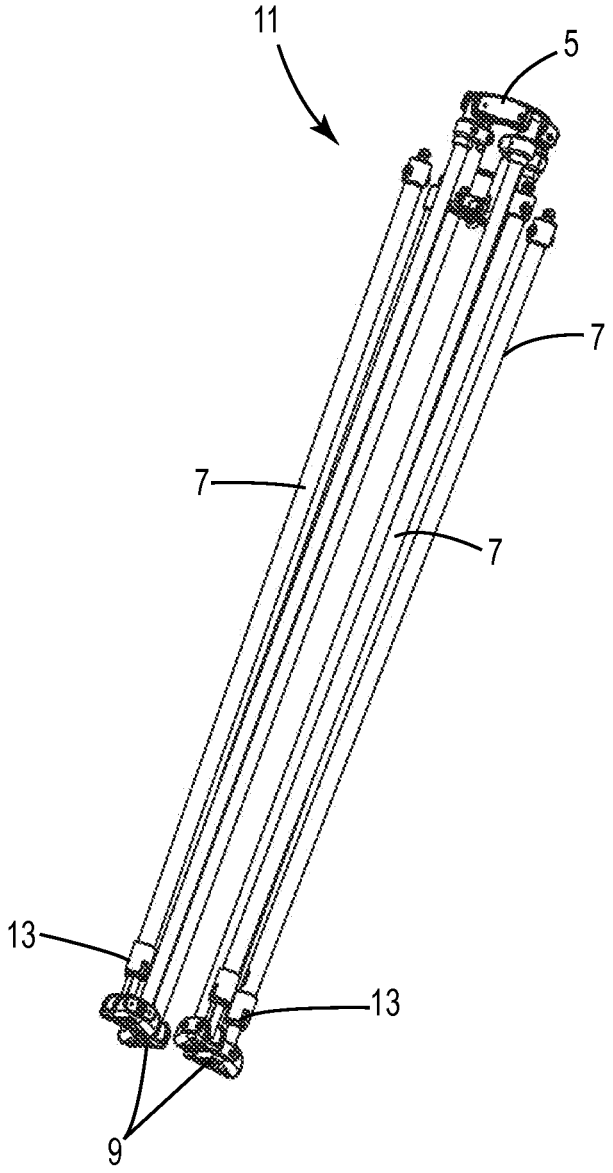
FIG. 7 is a perspective view of another embodiment of a pole assembly of a tent of the present invention in a fully folded or collapsed configuration.

Referring to FIG. 1, a first embodiment of a tent 1 of the present invention is shown. The tent 1 includes a frame or pole assembly 3 having a hub 5 and four poles 7 extending therefrom. The pole assembly 3 is unitary, free-standing and foldable or collapsible (as shown, e.g., in FIG. 7) making it extremely easy to put up, take down and transport. This type of pole assembly is used for collapsible tents which are commonly referred to as "instant tents," "one-touch tents" or "pop-up tents," which are sold preassembled. The pole assembly 3 of a first embodiment is described in detail in U.S. Pat. No. 7,861,736 (issued Jan. 4, 2011), which is incorporated by reference in its entirety. However, an alternative collapsible pole assembly 11, as shown in FIG. 7, could also be used for the tent 1. The pole assembly 11 of the alternative embodiment is described in detail in U.S. Patent App. Pub. No. 2011/0073147 (published Mar. 31, 2011), which is incorporated by reference in its entirety.

Referring to FIGS. 1 and 7, in general, in the pole assembly 3, 11 of each respective embodiment, the poles 7 are pivotally connected directly to the hub 5, and pivot to and from open and folded configurations without additional components or central locking mechanism. Each pole 7 includes collapsible sections which are foldable via a pivoting joint 9 and telescopically extendable and retractable via a telescoping locking member 13. The pole assembly 3, 11 defines an outer perimeter or frame of the tent 1. One of ordinary skill in the art will recognize that the number of poles could be modified to include as few as three and more than four without departing from the spirit and scope of the present invention. The collapsible sections of each pole 7 could also be modified, for example, to include a locking mechanism at the pivoting joint 9 or by replacing the telescoping locking member 13 with a pivoting joint.

Figure 2:
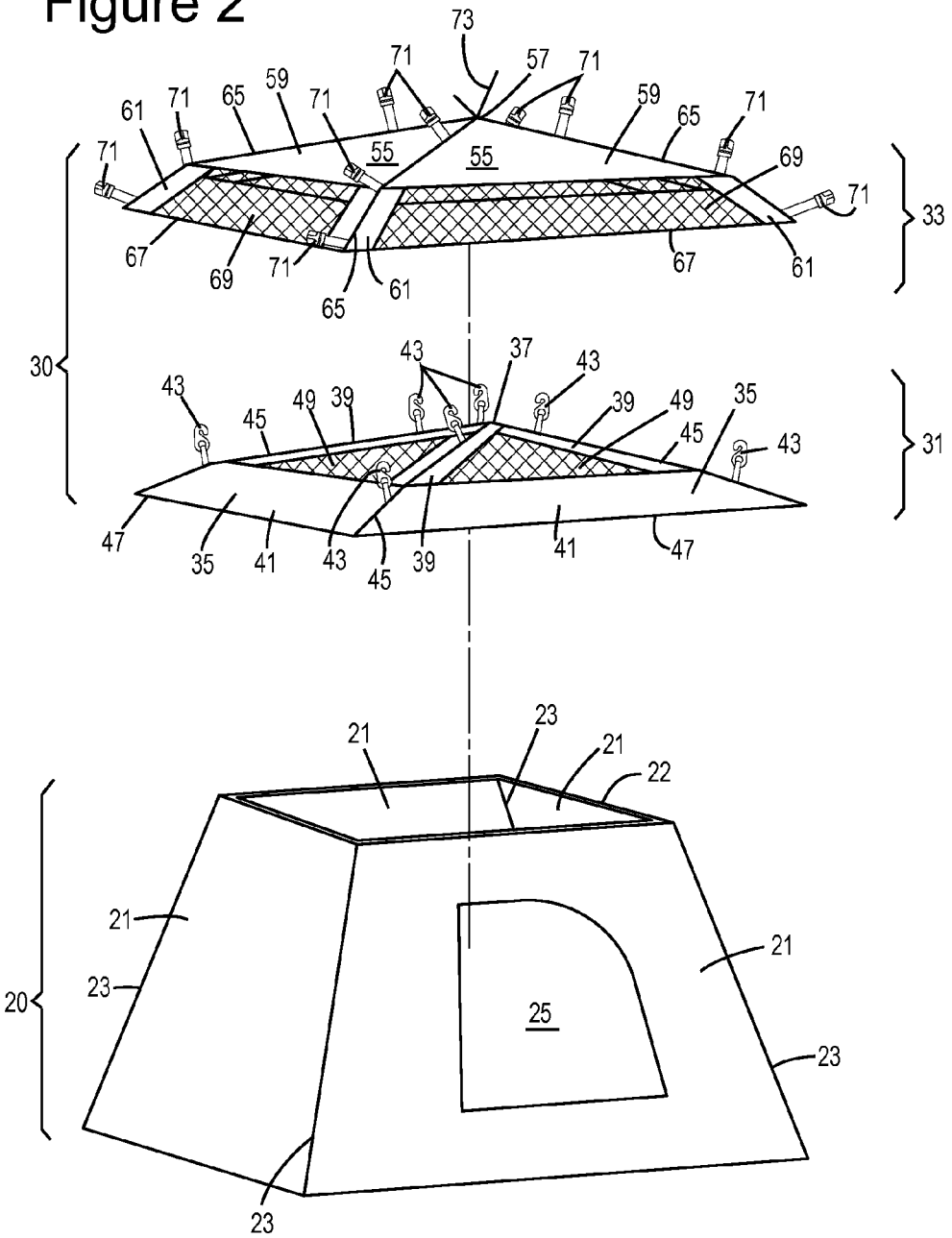
FIG. 2 is an exploded view of the tent of FIG. 1 without the pole assembly.
Figure 3:
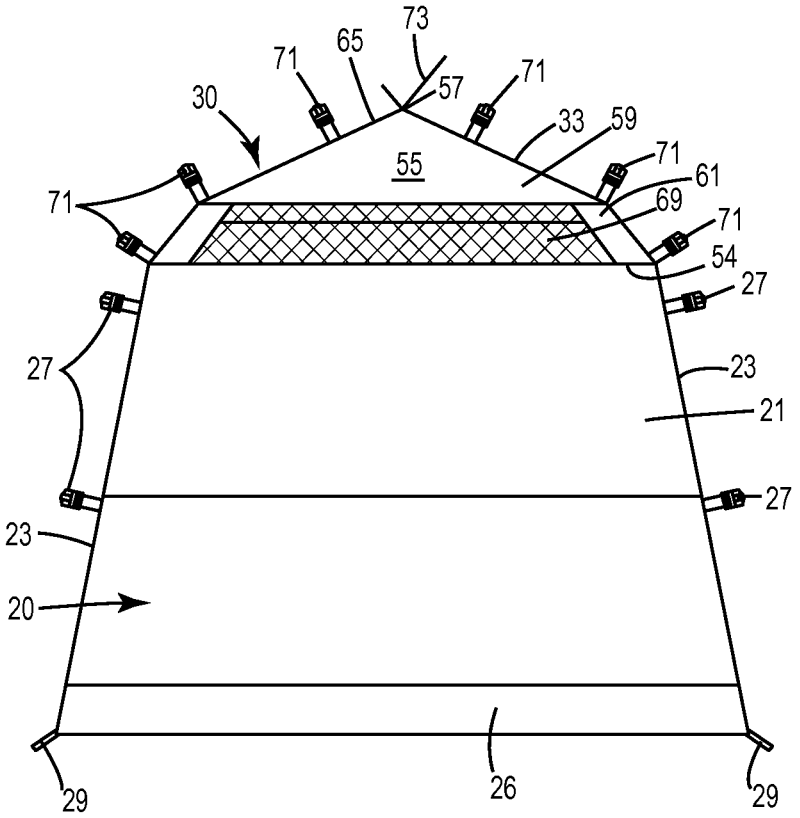
FIG. 3 is a rear view of the tent of FIG. 1 without the pole assembly.
Figure 4:
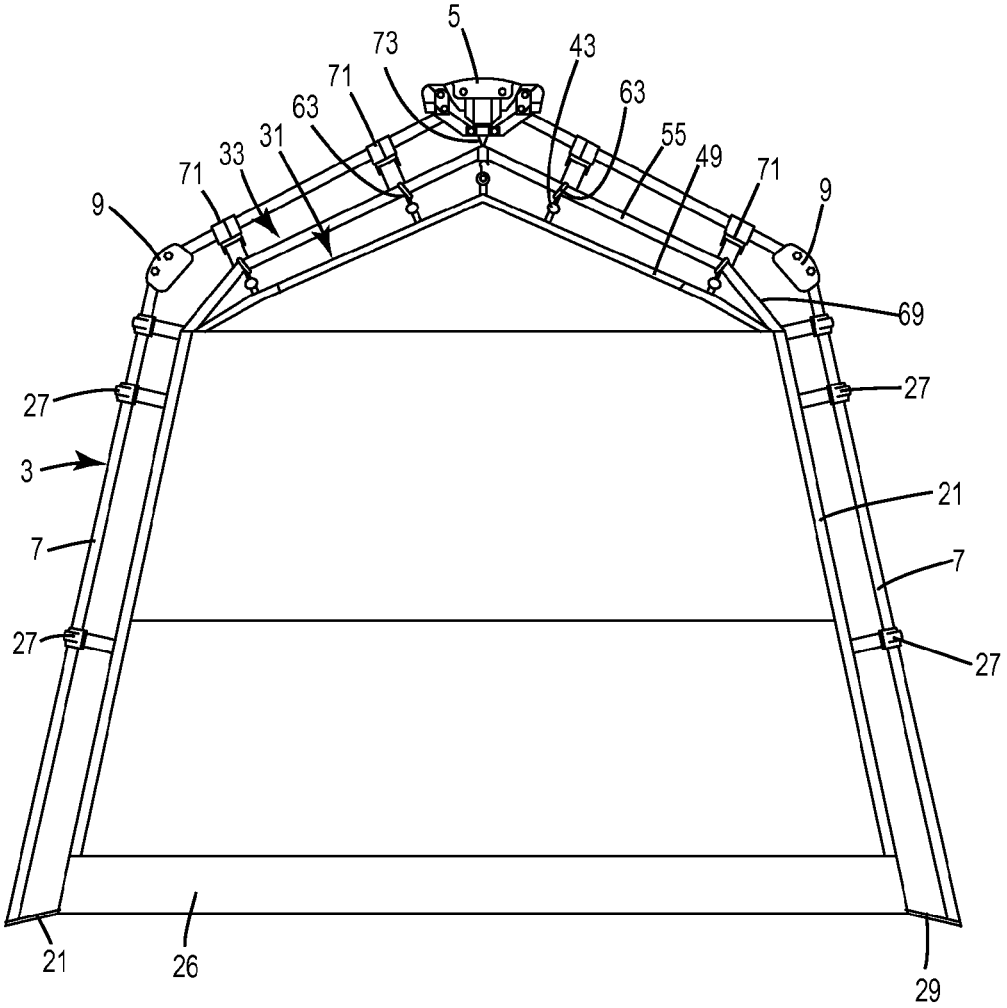
FIG. 4 is a superimposed sectional view of the tent of FIG. 1 taken along two separate sections denoted 4-4 and 4'-4' in FIG. 1.

Referring to FIGS. 1-4, the tent of the first embodiment 1 also includes a lower section 20 having four walls 21 and a floor 26, preferably a tub floor as shown in FIGS. 3 and 4, which are fixedly attached to each other by conventional sewing methods. One of ordinary skill in the art will recognize that the number of walls could be modified depending on the number of poles. In the preferred embodiment, the walls 21 are water and flame resistant, and are of a fabric constructed from materials such as cotton, polyester or nylon, or any combination thereof. The walls 21 can also be constructed with heat reflecting material. The floor 26 is preferably formed from a waterproof, flexible material such as taffeta nylon with a permanent waterproof coating (e.g., urethane), but other materials may be used. For example, the floor may be formed of polyethylene, such as low density polyethylene (LDPE).

Figure 5:
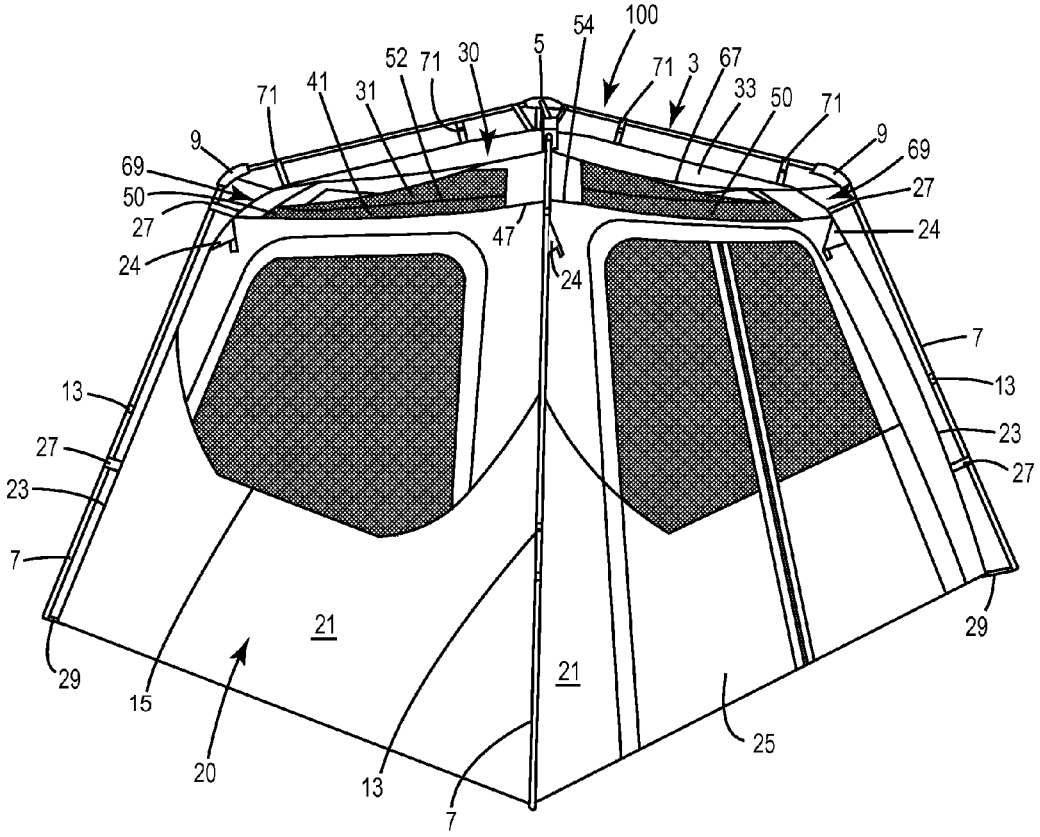
FIG. 5 is a side perspective view of another embodiment of a tent with an improved ventilation system of the present invention in an open configuration.

Referring again to FIGS. 1-4, the walls 21 include a door 25 and may include additional doors 25 and windows 15 as shown, for example, in FIG. 5. Vertical seams 23 of the lower section 20 outer surface also include a plurality of connecting members 27 (collectively, a third set of connecting members) for attaching the walls 21 to the poles 7, and corner straps 29 for attaching the lower section 20 to the ends of the poles 7 and for securing stakes (not shown) to a ground surface. In the preferred embodiment, the third set of connecting members 27 used to connect the lower section 20 to the poles 7 are hooks sized substantially similar to the poles 7 but with sufficient tolerance to be able to slide along the poles 7 when the tent 1 is collapsed. Other connecting means could be utilized such as a buckle assembly, a hook-and-loop closure or snap-fit buttons.

Referring to FIG. 5, the lower section 20 also preferably includes a loop extension 24 at each corner of the lower section 20 at a top portion 22 for attaching a rope (not shown) for securing to additional stakes (not shown) to a ground surface. A sealant tape (not shown) is added to the interior of the lower section 20 along all of the seams formed by stitch lines to further prevent water from leaking into the interior of the tent.

Referring to FIG. 2, the tent of the first embodiment 1 also includes an upper section 30 having an inner layer 31 and an outer layer 33. The inner layer 31 has four identical quadrants 35 fixedly attached together by conventional sewing methods which culminate at a center to form an apex 37. Radially inner portions 39 of each quadrant 35 are bordered by a tent fabric constructed of a material identical or similar to the material of the walls 21 described above. Radially outer portions 41 of each quadrant 35 also include the tent fabric. Openings 49 are formed between the surrounding tent fabric 39, 41 and are covered by an air permeable material such as mesh, which is fixedly attached to the surrounding tent fabric 39, 41 by conventional sewing methods. A plurality of first coupling members 43 extend from seams 45 formed by bordering quadrants 35 on an outer surface of the inner layer 31. A perimeter 47 of the inner layer 31 is fixedly attached to a top portion 22 of the lower section by conventional sewing methods to form an enclosure of the tent 1. A sealant tape (not shown) is added to the inner surface of the inner layer 31 along seams formed by stitch lines to further prevent water from entering the interior of the tent.

Referring again to FIG. 2, the outer layer 33 of the upper section 30 includes four identical quadrants 55 fixedly attached together by conventional sewing methods which culminate at a center to form an apex 57. Radially inner portions 59 of each quadrant 55 include a tent fabric constructed of a material identical or similar to the material of the walls 21 described above. The outermost edges of the inner portions 59 are positioned radially inside the perimeter of the inner layer 47. Each quadrant 55 is bordered also by the tent fabric at edges of radially outer portions 61, which are formed at a slightly steeper decline than the inner portions 59. Openings 69 are formed between the surrounding tent fabric 59, 61 and are covered by an air permeable material such as mesh, which is fixedly attached to the surrounding tent fabric 59, 61 by conventional sewing methods. A plurality of second coupling members 63 (shown in FIGS. 4 and 6) extend from seams 65 formed by the bordering quadrants 55 on an inner surface of the outer layer 33, and a plurality of third coupling members 71 extend from seams 65 formed by the bordering quadrants 55 on an outer surface of the outer layer 33. The apex 57 includes a tie 73 for attaching to the hub 5 of the pole assembly 3. A perimeter 67 of the outer layer 33 is fixedly attached to a top portion 22 of the lower section 20 by conventional sewing methods. Thus, an outer seam 54 is formed where the inner and outer layers 31, 33 are sewn to the top portion 22 of the lower section 20. A sealant tape (not shown) is added to the inner surface of the outer layer 33 along the seams formed by stitch lines to further prevent water from leaking through the seams.

It is possible that wildlife such as birds may be attracted to the space or gap provided between the inner and outer layers 31, 33. Bugs may also be attracted to the space especially at night time when lights are used by campers inside the tent 1. Therefore, in this embodiment, the mesh material covering the openings 69 prevent any wildlife, bugs or any debris from entering into the space formed between the inner and outer layers 31, 33.

Figure 6:
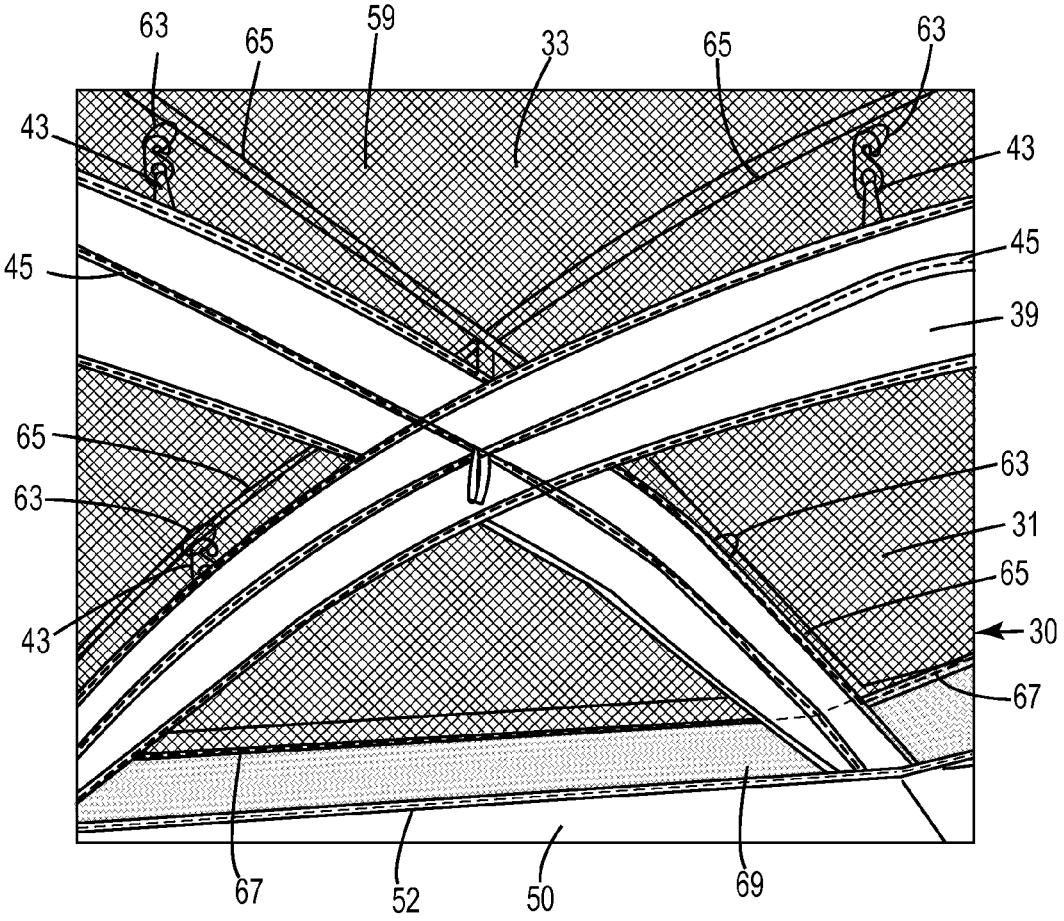
FIG. 6 is a bottom perspective view of an upper section of the tent of FIG. 5.

Referring to FIGS. 5 and 6, a second embodiment of a tent 100 of the present invention is shown. The general overall structure of the tent 100 is similar to the tent 1 of the first embodiment which is described in detail above. In this embodiment, however, the mesh material of the inner layer 31 extends through the outer portion 41 to the perimeter 47 forming an overlapping mesh and tent fabric portion 50. The mesh material is fixedly attached to the tent fabric of the outer portion 41 along both the inner and outer borders thereby forming two sets of horizontal seams 52, 54. The outer layer 33 of the upper section 30 is also substantially similar to that of the tent 1 of the first embodiment except that the openings 69 of the outer portion 61 do not include mesh material and are open instead.

Referring to FIGS. 1, 5 and 6, the inner layer and the outer layer of the upper section 31, 33 are connected together by engaging the first and second coupling members 43, 63 to form a first set of connecting members. In the preferred embodiment, as illustratively shown in FIG. 6, each connecting member of the first set 43, 63 are a hook-and-eye attachment but other means could be used such as a buckle assembly, a pair of hooks, a hook-and-loop closure or snap-fit buttons. The third coupling members 71 (or second set of connecting members) of the outer layer 33 are attached to the pole assembly 3. It is preferred that the third coupling members 71 are hooks sized substantially similar to the poles 7 but with sufficient tolerance to be able to slide along the poles 7 when the tent 1, 100 is collapsed. Other means could be utilized such as a buckle assembly, a hook-and-loop closure or snap-fit buttons.

Referring again to FIGS. 1, 5 and 6, when the tent 1, 100 is in an open configuration, the expanded pole assembly 3 exerts a tension on the lower and upper sections 20, 30 via the connecting members 27, 43, 63, 71 making the lower and upper sections 20, 30 substantially taut. The engagement of the tie 73 and hub 5 also provides a taut and raised center portion along a vertical axis in line with the apexes 37, 57. The upward tension from the pole assembly 3 and the downward force exerted by the weight of the inner layer 31 provides a constant space between the inner and outer layers 31, 33 which allows for sufficient air to travel from the interior to the exterior of the tent (and vice versa) for constant air circulation. The inner and outer layers 31, 33 are also formed at a decline to ensure that any runoff of precipitation is directed to the outer portions 41, 61 toward the outer seam 54.

Referring to FIGS. 1 and 2, in the tent 1 of the first embodiment, the mesh material on the openings 69 of the outer layer 61 prevents any significant amount of precipitation from reaching the tent fabric of the inner layer outer portion 41. The mesh material on the outer layer openings 69 also absorbs precipitation. Any precipitation reaching the inner layer outer portion 41 as well as any precipitation on the outer layer inner portion 59 travels downward due to the decline formed on the inner and outer layers 31, 33 and collects along the horizontal outer seams 54 formed along the top portion 22 of the lower section 20, which acts as a rain gutter. This prevents water from flowing down the mid portions of the walls 21 possibly into any windows 15 or doors 25 or into the seams of the windows 15 or doors 25. Instead, water accumulated along the outer seam 54 travels laterally and then flows down the corner portions of the tent 1 away from windows 15 and doors 25.

Referring to FIGS. 5 and 6, in the tent 100 of the second embodiment, the perimeter 67 of the outer layer 33 is disposed radially inside the horizontal seams 54 formed along the top portion 22 of the lower section 20 such that any precipitation from the top surface of the outer layer 33 travels onto the overlapping mesh material and tent fabric portion 50 of the inner layer 31 or the corner portions of the perimeter of the inner layer 47. The mesh material on the outer portions of the inner layer 41 also absorbs some precipitation. Similar to the tent of the first embodiment 1, water is collected on the overlapping mesh-tent fabric portion 50 along the horizontal outer seams 54 formed on the top portion 22 of the lower section 20, which acts as a rain gutter. This prevents water from flowing down the mid portions of the walls 21 possibly into any windows or doors 25 or into the seams of the windows or doors 25. Instead, the accumulated water travels laterally and then flows down the corner portions of the tent 100 away from windows and doors 25. In either embodiment of the tent 1, 100, it is possible to add a semi-rigid concave lining along the outer horizontal seams 54 on the top portion 22 of the lower section 20 to further prevent water from flowing onto the mid portions of the tent walls 21. It is also possible to use either of the inner and outer layers 31, 33 of either of the first and second embodiments 1, 100 interchangeably.

Referring to FIGS. 1 and 5, the configuration of the upper section 30, namely, the openings 49, 69 of the inner and outer layers 31, 33, respectively, also allows the tent 1, 100 to remain more stable during windy conditions. That is, the upper section 30 is not vulnerable to wind force because the openings 49, 69 and the space between the inner and outer layers 31, 33 provide a passage way for the wind, thereby preventing the tent 1, 100 from toppling or having a toppling effect. In addition, given that the upper section of the tent 30 has the most exposure to direct sunlight, the outer layer 33 provides the tent 1, 100 with additional protection from overheating and any heat absorbed by the outer layer 33 is dissipated through the space formed between the inner and outer layers 31, 33.

Referring to FIG. 7, the pole assembly of the second embodiment 11 is shown without the lower and upper sections 20, 30 to more clearly illustrate how the tent is folded into a compact configuration. The folding function of the pole assembly of the first embodiment 3 is identical to that of the second pole assembly 11. The tent 1, 100 is collapsed by retracting the poles 7 surrounding the lower section 20 and folding the poles 7 about the pivoting joints 9 collectively with the lower and upper section 20, 30. In the fully collapsed compact configuration, the folded poles 7 are parallel and adjacent each other for easy storage and transport.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tent comprising:

a pole assembly having a plurality of collapsible poles pivotally coupled to a hub, wherein in an open state of the tent the poles are extended to form an area between the extended poles;

a canopy having a lower section defined by a plurality of walls and a floor and an upper section having an inner layer and an outer layer, the inner layer comprising an air permeable material, a perimeter of the inner layer fixedly attached to a top portion of the lower section to form an enclosure, the outer layer disposed above the inner layer, openings formed between a perimeter of the outer layer and the top portion of the lower section;

a first set of connecting members connecting the inner and outer layers and forming a space therebetween; and a second set of connecting members connecting the outer layer and the pole assembly;

wherein in the open state of the tent the canopy is coupled to the pole assembly such that the entire canopy is disposed within the area between the extended poles, and in a folded state of the tent the canopy and pole assembly are collectively collapsed and folded into a compact configuration.

2. A tent in accordance with claim 1, further comprising an air permeable material coupled between the outer layer perimeter and the top portion of the lower section.

3. A tent in accordance with claim 2, further comprising an outer seam formed from joining the lower section top portion and the air permeable material of the outer layer.

4. A tent in accordance with claim 1, wherein each of the connecting members of the first set comprises a first coupling member extending from a top side of the inner layer coupled to a second coupling member extending from a bottom side of the outer layer.

5. A tent in accordance with claim 4, wherein each combination of first and second coupling members is selected from a group comprising a buckle assembly, a pair of hooks, a hook-and-loop closure or snap-fit buttons.

6. A tent in accordance with claim 1, wherein each connecting member of the second set is selected from a group comprising a buckle assembly, a hook, a hook-and-loop closure or snap-fit buttons.

7. A tent in accordance with claim 1, wherein at least one connecting member of each of the first and second sets are substantially aligned with each other.

8. A tent comprising:

a pole assembly having at least two collapsible sections, wherein in an open state of the tent the pole assembly is extended to form an area within a radially inner portion thereof;

a canopy having a lower section defined by a plurality of walls and a floor, and an upper section having an inner layer and an outer layer, the inner layer comprising a first set of openings and a perimeter, said perimeter fixedly attached to a top portion of the lower section to form an enclosure, the outer layer disposed above the inner layer, a second set of openings formed between a perimeter of the outer layer and the perimeter of the inner layer;

wherein the inner and outer layers are attached together by a first set of connecting members and forms a space therebetween, and the pole assembly is attached to the outer layer and the lower section by a second set of connecting members; and wherein in the open state of the tent the canopy is coupled to the pole assembly such that the entire canopy is disposed within the area between the extended pole assembly, and in a folded state of the tent the canopy and pole assembly are collectively collapsed and folded into a compact configuration.

9. A tent in accordance with claim 8, wherein the first set of openings is covered with an air permeable material.

10. A tent in accordance with claim 9, wherein the inner layer further comprises a tent fabric overlapping with the air permeable material at an outer portion extending along the perimeter.

11. A tent in accordance with claim 8, wherein the second set of openings is covered with an air permeable material.

12. A tent in accordance with claim 8, wherein at least one connecting member of each of the first and second sets on the upper section are substantially aligned with each other.

13. A tent comprising:

a pole assembly having a plurality of poles pivotally coupled to a hub; and a tent fabric having an inner layer and an outer layer, the inner and outer layers being disposed on an upper portion of the tent, the inner layer having an inner fabric portion and at least one inner opening, the outer layer having an outer fabric portion and at least one outer opening, said outer fabric portion slidably coupled to the pole assembly, the outer fabric portion coupled to the inner fabric portion and spaced apart therefrom, the outer fabric portion positioned adjacent to the at least one opening of the inner layer;

wherein in an open state of the tent the poles are extended to form an area between the extended poles, wherein the entire tent fabric is disposed within the area.

14. A tent in accordance with claim 13, wherein the inner and outer fabric portions are coupled together by a connecting member selected from a group comprising a buckle assembly, a hook, a hook-and-loop closure and snap-fit buttons.

* * * * *